US011285359B1

(12) United States Patent
Bartolomei

(10) Patent No.: US 11,285,359 B1
(45) Date of Patent: Mar. 29, 2022

(54) PLATFORM ASSEMBLY

(71) Applicant: Brian Joseph Bartolomei, Vista, CA (US)

(72) Inventor: Brian Joseph Bartolomei, Vista, CA (US)

( * ) Notice: Subject to any disclaimer, the term of this patent is extended or adjusted under 35 U.S.C. 154(b) by 0 days.

(21) Appl. No.: 16/891,471

(22) Filed: Jun. 3, 2020

(51) Int. Cl.
*A63B 21/00* (2006.01)

(52) U.S. Cl.
CPC .... *A63B 21/4033* (2015.10); *A63B 21/00047* (2013.01); *A63B 2208/0204* (2013.01); *A63B 2209/00* (2013.01)

(58) Field of Classification Search
CPC ..... A63B 21/4033; A63B 23/10; A63B 6/00; A63B 21/00047; A63B 2209/00; A63B 2208/0204
See application file for complete search history.

(56) References Cited

U.S. PATENT DOCUMENTS 5,643,164 A * 7/1997 Teff ..... A63B 22/16 482/146
8,734,308 B1 * 5/2014 Joslin ..... A63B 21/4037 482/146
2004/0014571 A1 * 1/2004 Haynes ..... A63B 21/0004 482/142
2011/0256987 A1 * 10/2011 Lepore ..... A63B 23/0458 482/52
2013/0324382 A1 * 12/2013 Wilson ..... A63B 23/0211 482/142
2016/0199690 A1 * 7/2016 Islas ..... A63B 21/4037 482/79
2020/0179745 A1 * 6/2020 Randleman ..... A63B 21/4035

* cited by examiner

*Primary Examiner* — Andrew S Lo
*Assistant Examiner* — Andrew M Kobylarz

(57) ABSTRACT

A platform assembly has a central platform joined to a first side platform and a second side platform. A first side platform first corner socket and a first side platform second corner socket arranged through the first platform. A first cross member support is joined to the first side platform with a first cross member locking pin through the first corner socket and a second cross member locking pin through the second corner socket. A second side platform first corner socket and a second side platform second corner socket arranged through the second platform. A second cross member support is joined to the second side platform with a second cross member first locking pin through the second side platform first corner socket and a second cross member second locking pin through the second side platform second corner socket.

5 Claims, 4 Drawing Sheets

PLATFORM ASSEMBLY

BACKGROUND

Prior to embodiments of the disclosed invention when using a suspension trainer in a traditional way, one is limited by the traction of one's shoes as the amount of resistance is determined by the angle of the user's body. If the angle is too steep, the shoes lose traction and slipping can occur. Embodiments of the disclosed invention solve this problem.

SUMMARY

A platform assembly is configured to enable a user to effectively engage in suspension training. The platform assembly has a central platform, joined to a first side platform and a second side platform. A first side platform first corner socket and a first side platform second corner socket arranged through the first platform. A first cross member support is joined to the first side platform with a first cross member locking pin through the first corner socket and a second cross member locking pin through the second corner socket. A second side platform first corner socket and a second side platform second corner socket arranged through the second platform. A second cross member support is joined to the second side platform with a second cross member first locking pin through the second side platform first corner socket and a second cross member second locking pin through the second side platform second corner socket. A user standing on the first cross member can effectively engage is suspension training.

In some embodiments, the first side platform further comprises a first side platform third corner socket and a first side platform fourth corner socket. The first cross member support further comprises a first cross member support flat portion and a first cross member support rounded portion; a first incline angle is measured counter clockwise from the first side platform to the first cross member support flat portion; wherein the first incline angle is at least 100 degrees but no more than 150 degrees.

In some embodiments, the second side platform further comprises a second side platform third corner socket and a second side platform fourth corner socket. The second cross member support further comprises a second cross member support flat portion and a second cross member support rounded portion; a second incline angle is measured counter clockwise from the second side platform to the second cross member support flat portion; wherein the second incline angle is at least 100 degrees but no more than 150 degrees.

In some embodiments, the central platform, the first side platform, and the second side platform further comprise a sheet of acrylonitrile butadiene styrene plastic that is highly textured with a non-slip surface and joined a silicone pad that provides surface adhesion.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
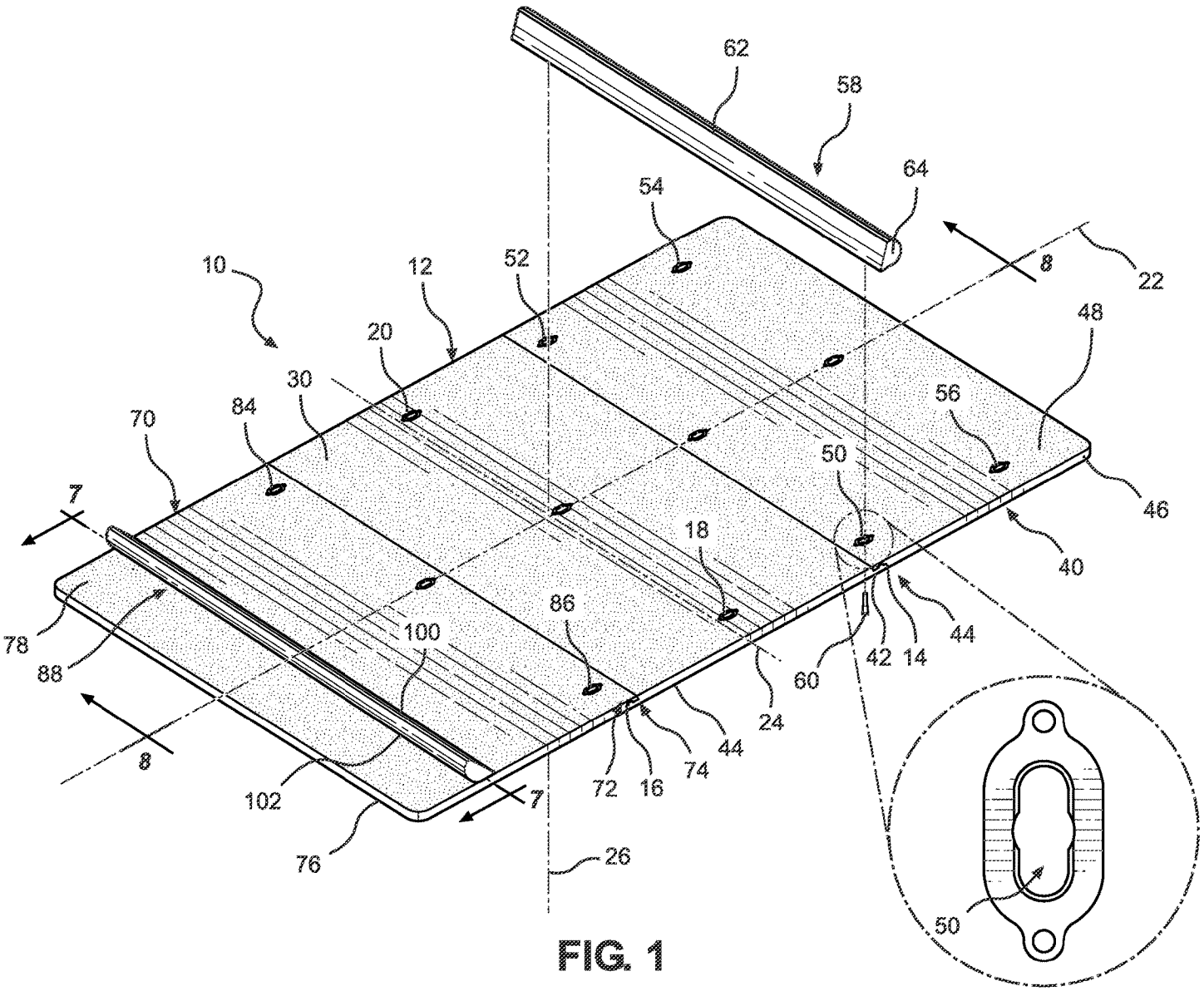
FIG. 1 shows a top perspective view of one embodiment of the present invention.
Figure 2:
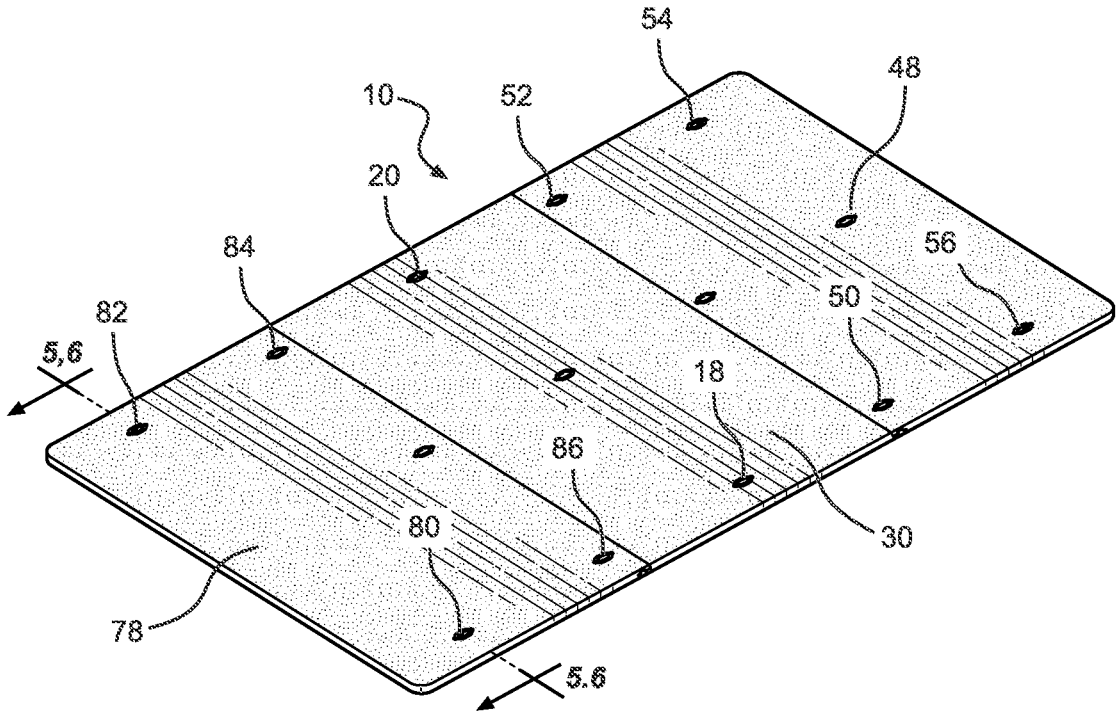
FIG. 2 shows a top perspective view of one embodiment of the present invention.
Figure 3:
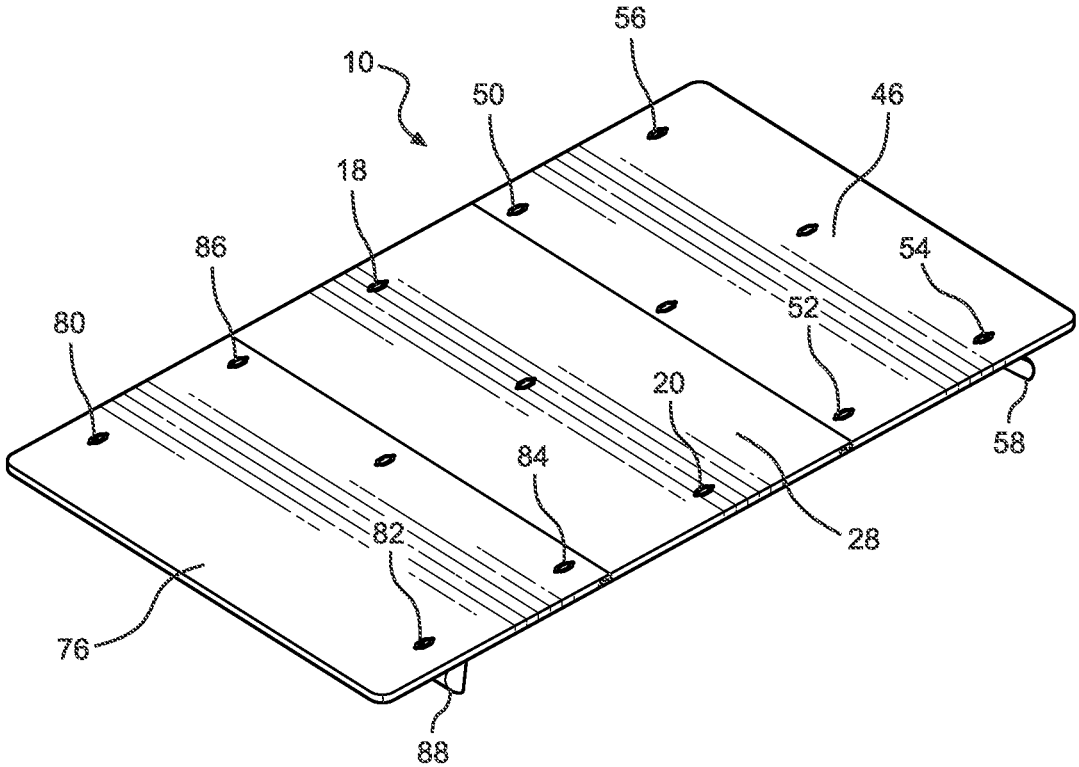
FIG. 3 shows a bottom perspective view of one embodiment of the present invention.
Figure 4:
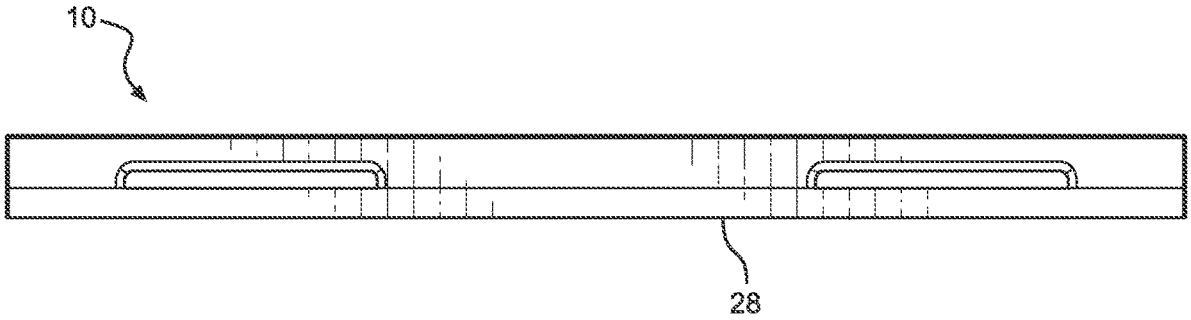
FIG. 4 shows a front perspective view of one embodiment of the present invention.
Figure 5:
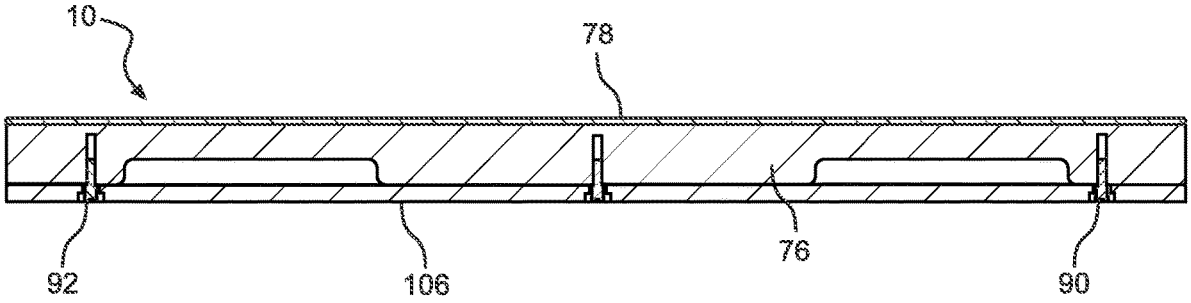
FIG. 5 shows a front cross section view of one embodiment of the present invention.
Figure 6:
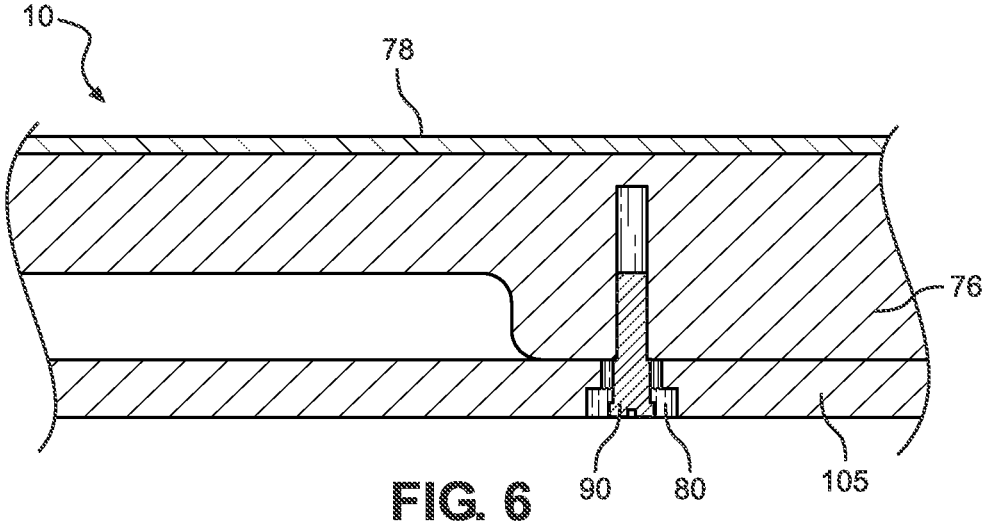
FIG. 6 shows a detail cross section view of one embodiment of the present invention.
Figure 7:
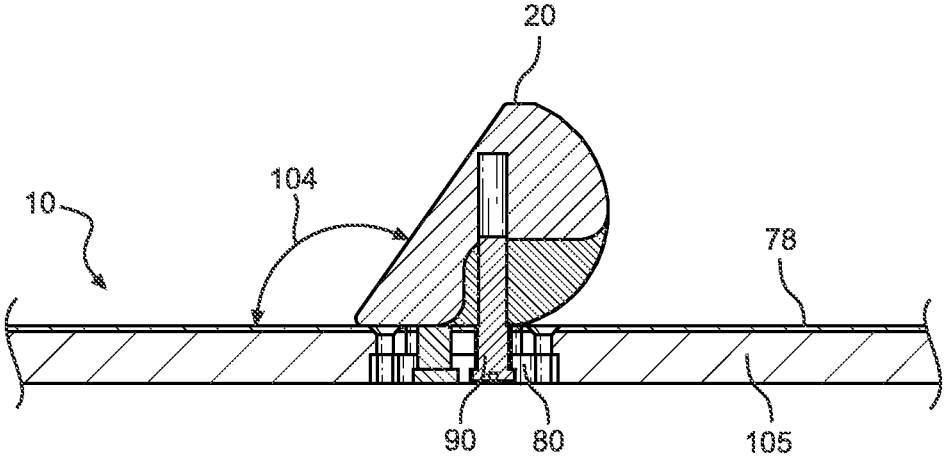
FIG. 7 shows a detail cross section view of one embodiment of the present invention.
Figure 8:
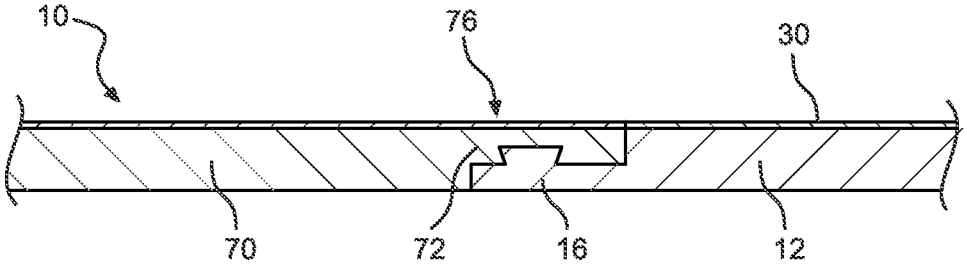
FIG. 8 shows a detail cross section view of one embodiment of the present invention.

By way of example, and referring to FIG. 1, one embodiment of a platform assembly 10 further comprises a central platform 12. The central platform 12 further comprises a central platform first receiver opening 14 and a central platform first receiver opening 16. The central platform 12 further comprises a central platform first side socket 18 and a central platform second side socket 20. The central platform first side socket 18 and the central platform second side socket 20 are arranged parallel to a central platform minor axis 22, perpendicular to a central platform major axis 24 and also perpendicular to a central platform thickness axis 26. The central platform 12 further comprises a central platform molded plastic body 28 covered by a central platform textured layer 30.

A first side platform 40 further comprises a first side platform tail 42. The first side platform tail slides 42 into the central platform first side socket 18 parallel to the central platform minor axis 22 to join the central platform 12 to the first side platform 40 forming a first side dovetail joint 44. The first side platform 40 further comprises a first platform molded plastic body 46 covered by a central platform textured layer 48.

The first side platform 40 further comprises a first side platform first corner socket 50, a first side platform second corner socket 52, a first side platform third corner socket 54, and a first side platform fourth corner socket 56. A first cross member support 58 is joined to the first side platform first corner socket 50 and the first side platform second corner socket 52 with a first side platform first locking pin 60 and a first side platform second locking pin (not shown). The first cross member support 58 further comprises a first cross member support flat portion 62 and a first cross member support rounded portion 64. A first incline angle can be measured counter clockwise from the first side platform 40 to the first cross member support flat portion 62. The first incline angle is at least 100 degrees but no more than 150 degrees. The first incline angle can be approximately 125 degrees.

A second side platform 70 further comprises a second side platform tail 72. The second side platform tail slides 72 into the central platform second side socket 20 parallel to the central platform minor axis 22 to join the central platform 12 to the second side platform 70 forming a second side dovetail joint 74. The second side platform 70 further comprises a second platform molded plastic body 76 covered by a central platform textured layer 78.

The second side platform 70 further comprises a second side platform second corner socket 80, a second side platform second corner socket 82, a second side platform third corner socket 84, and a second side platform fourth corner socket 86. A second cross member support 88 is joined to the second side platform second corner socket 80 and the second side platform second corner socket 82 with a second side platform first locking pin 90 and a second side platform second locking pin 92. The second cross member support 88 further comprises a second cross member support flat portion 100 and a second cross member support rounded portion 102. A second incline angle 104 can be measured counter clockwise from the second side platform 70 to the second cross member support flat portion 100. The second incline angle 104 is at least 100 degrees but no more than 150 degrees. The second incline angle 104 can be approximately 125 degrees.

In some embodiments, the central platform 12, the first side platform 40 and the second side platform 70 can be a ⅜ inch thick by 35-inch wide by 5-foot long sheet of acrylonitrile butadiene styrene (ABS) plastic that is highly textured with a non-slip surface. The ABS plastic can be joined to a silicone pad that provides surface adhesion when the platform is not recessed into flooring.

In some embodiments, the first cross member support 58 and the second cross member support 88 can be a 2.25-inch tall by 4-inch wide by 35-inch long beam of ABS plastic. Along the length of one side, the beam is cut at a 55 degree angle and the other side has an outward curve. Molded into the cross members are three pins that attach the cross member to the base.

In some embodiments, the locking pins can be ⅜-inch capture pins. These capture pins have a small grove that seats into a channel when inserted into the receiver located on the platform. Pulling the cross member backwards releases the pin from the socket allowing free position adjustment along the base.

In some embodiments, the platform collectively utilize five parallel sets of three sockets spaced 15 inches apart down the length of the base. The sockets can be ½-inch wide by ⅜-inch deep by 1.2 inches long and designed to match up with the capture pins from the cross member. Within the socket is a channel designed to lock the capture pin to the socket.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 116. In particular, any use of "step of" in the claims is not intended to invoke the provision of 35 U.S.C. § 112, ¶ 116.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A platform assembly, configured to enable a user to effectively engage in suspension training; the platform assembly comprising:

a central platform, joined to a first side platform and a second side platform;

a first side platform first corner socket and a first side platform second corner socket arranged through the first platform;

a first cross member support, joined to the first side platform with a first cross member locking pin through the first corner socket and a second cross member locking pin through the second corner socket;

a second side platform first corner socket and a second side platform second corner socket arranged through the second platform; and a second cross member support, joined to the second side platform with a second cross member first locking pin through the second side platform first corner socket and a second cross member second locking pin through the second side platform second corner socket; the first cross member support further comprises a first cross member support flat portion and a first cross member support rounded portion; a first incline angle is measured counter clockwise from the first side platform to the first cross member support flat portion; wherein the first incline angle is at least 100 degrees but no more than 150 degrees; the first cross member support flat portion and first cross member support rounded portion each have a length identical to the a length of the first cross member; wherein the first cross member is configured for a user to stand on to effectively engage in suspension training exercises.

2. The platform assembly of claim 1, wherein the first side platform further comprises a first side platform third corner socket and a first side platform fourth corner socket.

3. The platform assembly of claim 2, wherein the second side platform further comprises a second side platform third corner socket and a second side platform fourth corner socket.

4. The platform assembly of claim 3, wherein the central platform, the first side platform, and the second side platform further comprises a sheet of acrylonitrile butadiene styrene plastic that is highly textured with a non-slip surface and joined a silicone pad that provides surface adhesion.

5. The platform assembly of claim 1, wherein the second cross member support further comprises a second cross member support flat portion and a second cross member support rounded portion; a second incline angle is measured counter clockwise from the second side platform to the second cross member support flat portion; wherein the second incline angle is at least 100 degrees but no more than 150 degrees.

* * * * *